US008297532B2

(12) United States Patent
Venkataraghavan et al.

(10) Patent No.: US 8,297,532 B2
(45) Date of Patent: Oct. 30, 2012

(54) APPARATUS FOR COOLING A FUEL INJECTOR

(75) Inventors: Jay Venkataraghavan, Dunlap, IL (US); Stephen R. Lewis, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 1150 days.

(21) Appl. No.: 12/157,268

(22) Filed: Jun. 9, 2008

(65) Prior Publication Data

US 2009/0302130 A1 Dec. 10, 2009

(51) Int. Cl.
*B05B 1/00* (2006.01)
*F02M 51/06* (2006.01)

(52) U.S. Cl. ..... 239/132; 123/472

(58) Field of Classification Search ..... 251/129.1, 251/129.11, 129.15, 129.22; 239/132; 123/472
See application file for complete search history.

(56) References Cited

U.S. PATENT DOCUMENTS 2,858,813 A 11/1958 Haas
2,898,895 A 8/1959 Koppel et al.
3,945,353 A 3/1976 Dreisin
4,922,878 A 5/1990 Shinogle
5,351,889 A 10/1994 Whiteside
5,794,860 A 8/1998 Neumann
6,092,784 A 7/2000 Kalfsbeck
6,481,641 B1 11/2002 Mieney
6,607,172 B1 8/2003 Green et al.
6,668,641 B2 12/2003 Ambrosina et al.
6,769,383 B2 8/2004 Doers et al.
6,814,303 B2 11/2004 Edgar et al.
7,021,047 B2 4/2006 Hilden et al.
7,028,918 B2 4/2006 Buchanan et al.
2006/0097072 A1 5/2006 Nau et al.
2008/0295806 A1 * 12/2008 Chang et al. ..... 123/470

* cited by examiner

*Primary Examiner* — Stephen K Cronin
*Assistant Examiner* — Arnold Castro
(74) *Attorney, Agent, or Firm* — Miller, Matthias & Hull

(57) ABSTRACT

A fuel injector including a nozzle portion, a solenoid operated valve assembly configured to control a flow of fuel to the nozzle portion, a housing, at least a portion of the solenoid operated valve assembly disposed in the housing, the housing formed of a first material having a first thermal conductivity value, and a heat transfer element associated with the solenoid operated valve assembly, the heat transfer element attached to the housing, the heat transfer element formed of a second material having a second thermal conductivity value, the second thermal conductivity value being greater than the first thermal conductivity value.

20 Claims, 4 Drawing Sheets

APPARATUS FOR COOLING A FUEL INJECTOR

TECHNICAL FIELD

The present disclosure relates to a fuel injector, and, more particularly, to an apparatus for cooling a fuel injector.

BACKGROUND

Some engines use fuel injection systems to introduce fuel into the combustion chambers and/or a regeneration system of the engine. The fuel injection system may be any one of various types of fuel systems and may include, within the system, a number of fuel injectors. Among the various valves controlling the flow of fuel, a fuel injector may include at least one solenoid operated valve assembly. A solenoid operated valve assembly may include a solenoid and an associated valve. The solenoid may include a solenoid coil, a stator that acts as a magnet when the solenoid coil is provided with current, an armature, and a biasing or return spring. The armature is movable relative to the stator to actuate the valve.

A solenoid operated valve assembly may cause the operating temperature of the fuel injector to rise higher than desired, particularly in view of higher fuel pressures utilized in the fuel injection systems. In some instances, without some dedicated means for cooling engine system components, in particular, fuel injector components, operation of the fuel system and associated engine system may be sub-optimal, or even compromised altogether.

U.S. Pat. No. 6,607,172 (the '172 patent), issued on Aug. 19, 2003 in the name of Green et al. and assigned to Borg-Warner Inc., discloses one example of an apparatus for cooling a solenoid operated valve. The '172 patent discloses a solenoid operated exhaust gas recirculation valve which is mounted to an engine component via a mounting bracket. The mounting bracket functions as a heat sink to siphon heat from the valve and distribute to other engine components. Although the mounting bracket in the '172 patent is adjacent the solenoid operated valve, it is not situated to provide any heat dissipating effect for a solenoid operated assembly associated with a fuel injector. Furthermore, the positioning of the mounting bracket in the '172 patent is cumbersome and requires additional mounting space around a circumference of the valve to provide heat dissipation effects.

The disclosed apparatus for cooling a fuel injector is directed to improvements in the existing technology.

SUMMARY

In one aspect, the present disclosure is directed toward a fuel injector including a nozzle portion; a solenoid operated valve assembly configured to control a flow of fuel to the nozzle portion; a housing, at least a portion of the solenoid operated valve assembly disposed in the housing, the housing formed of a first material having a first thermal conductivity value; and a heat transfer element associated with the solenoid operated valve assembly, the heat transfer element attached to the housing, the heat transfer element formed of a second material having a second thermal conductivity value, the second thermal conductivity value being greater than the first thermal conductivity value.

In another aspect, the present disclosure is directed toward a heat transfer assembly for a solenoid operated valve assembly including a housing configured to contain at least a portion of the solenoid operated valve assembly, the housing formed of a first material having a first thermal conductivity value; and a heat transfer element attached to the housing, the heat transfer element formed of a second material having a second thermal conductivity value, the second thermal conductivity value being greater than the first thermal conductivity value; wherein the heat transfer element is axially arranged relative to the housing along an axis of the solenoid operated valve assembly.

In yet another aspect, the present disclosure is directed toward a machine including an engine configured to generate a power output and including at least one combustion chamber; and a fuel injector configured to inject fuel into the at least one combustion chamber, the fuel injector including: a nozzle portion; a solenoid operated valve assembly configured to control a flow of fuel to the nozzle portion; a housing, at least a portion of the solenoid operated valve assembly disposed in the housing, the housing formed of a first material having a first thermal conductivity value; and a heat transfer element associated with the solenoid operated valve assembly, the heat transfer element attached to the housing, the heat transfer element formed of a second material having a second thermal conductivity value, the second thermal conductivity value being greater than the first thermal conductivity value.

DETAILED DESCRIPTION

Figure 1:
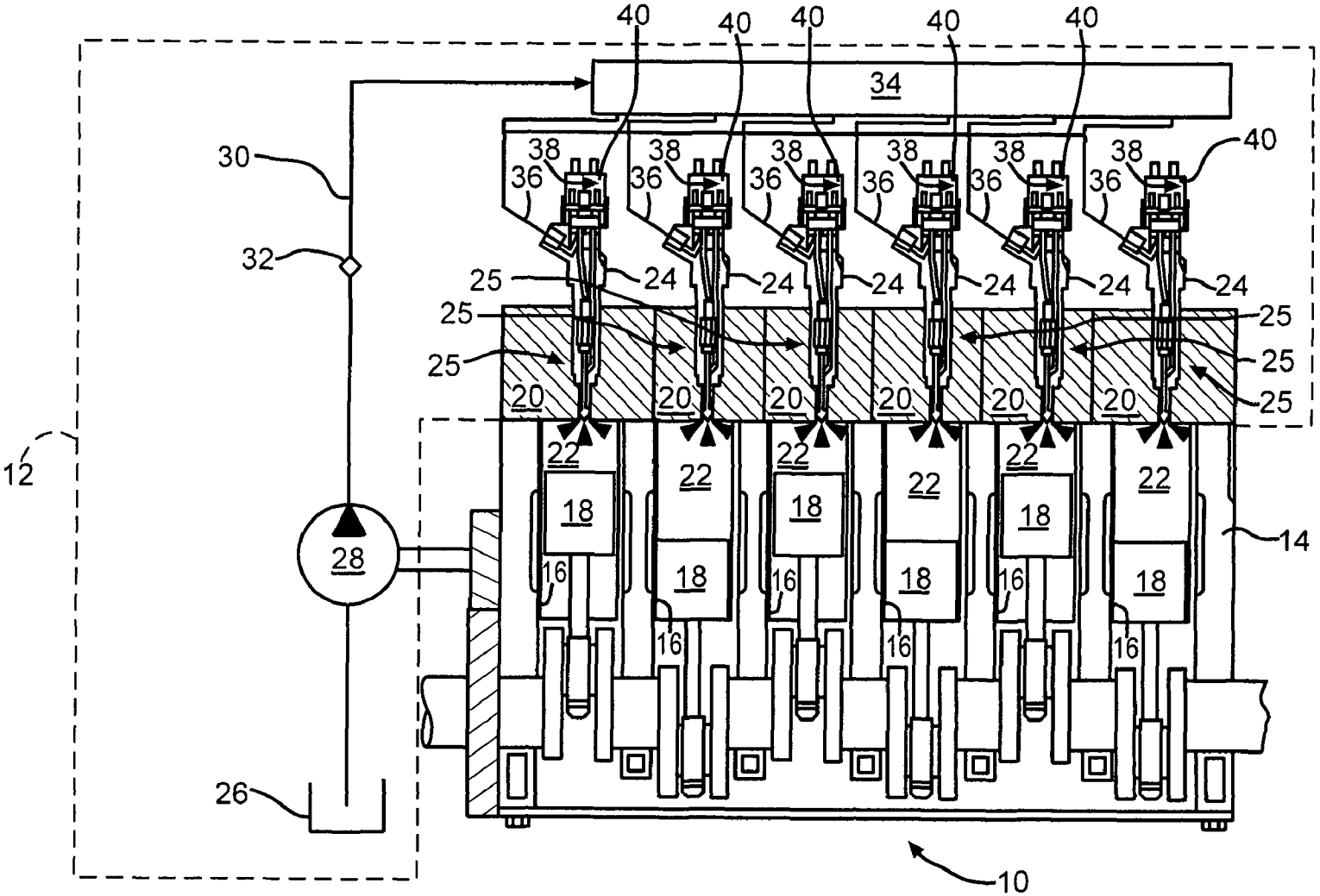
FIG. 1 is a schematic and diagrammatic illustration of an exemplary fuel injection system for an engine.

FIG. 1 diagrammatically illustrates an engine 10 with a fuel injection system 12. Engine 10 includes an engine block 14 that defines a plurality of cylinders 16, a piston 18 slidably disposed within each cylinder 16, and a cylinder head 20 associated with each cylinder 16. The cylinder 16, the piston 18, and the cylinder head 20 form a combustion chamber 22. The fuel injection system 12 includes components that cooperate to deliver fuel to fuel injectors 24, which in turn deliver fuel into each combustion chamber 22. Specifically, the fuel injection system 12 includes a supply tank 26, a fuel pump 28, a fuel line 30 with a check valve 32, and a manifold or fuel rail 34. From the fuel rail 34, fuel is supplied to each fuel injector 24 through a fuel line 36. As shown, each fuel injector 24 includes one or more solenoid operated valve assemblies 38 and a fuel injector nozzle portion 25. Each solenoid operated valve assembly 38 may include an associated solenoid (not shown) for controlling a valve element for controlling the flow of fuel to the fuel injector nozzle portion 25 to inject fuel into the combustion chambers 22.

Figure 3:
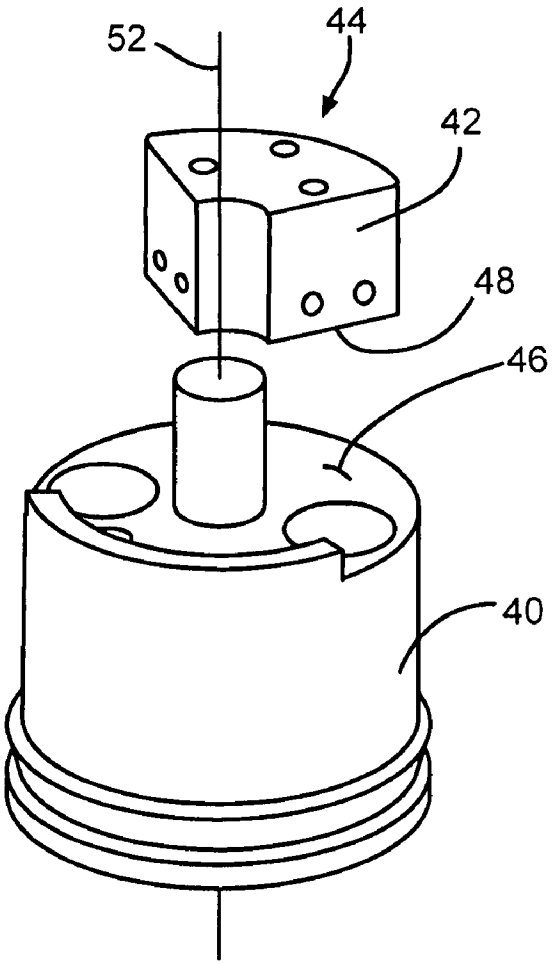
FIG. 3 is an exploded perspective view of the fuel injector solenoid housing and the heat sink of FIG. 2.
Figure 2:
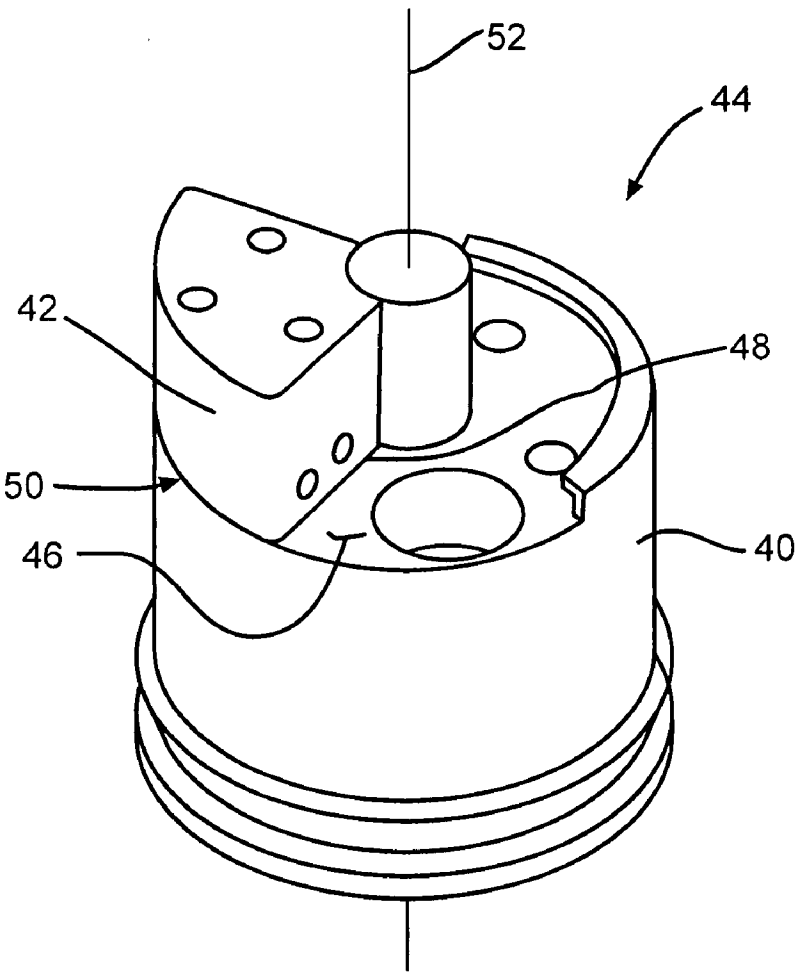
FIG. 2 is a perspective view of a fuel injector solenoid housing and an associated heat sink according to an exemplary embodiment of the present disclosure.

Referring now to FIGS. 2 and 3, an exemplary embodiment of a heat transfer assembly is shown and includes a solenoid housing 40 and a heat sink or heat transfer element 42. The solenoid housing 40 and the heat sink 42 together define a heat transfer assembly 44. The heat sink 42 provides a convenient and efficient way to absorb and dissipate excess heat generated within the solenoid housing 40, such as the heat generated by the associated solenoid of the solenoid operated valve assembly 38 (FIG. 1) and by fuel within the fuel injector 24 (FIG. 1) proximate the solenoid housing 40, thereby effectively cooling the fuel injector 24 associated with the solenoid housing 40. In an exemplary embodiment, the heat transfer assembly 44 is disposed at an opposite end of the fuel injector 24 relative to the nozzle portion 25.

The solenoid housing 40 includes an outer surface 46 and the heat sink 42 includes a surface 48. In operation as shown in FIG. 2, the outer surface 46 and the surface 48 are in thermal contact to transfer heat from the solenoid housing 40 to the heat sink 42. The interface between the outer surface 46 and the surface 48 defines a heat transfer interface 50. The heat sink 42 in turn dissipates the heat to the surrounding ambient air and/or to other components of the engine 10 (FIG. 1). The heat sink 42 functions by efficiently transferring thermal energy, e.g., heat, from a first object, e.g., the solenoid housing 40, at a relatively high temperature, to a second object, e.g., air or other components of the engine 10, at a relatively lower temperature with a much greater heat capacity. The transfer of thermal energy brings the solenoid housing 40 into thermal equilibrium with the air or other components of the engine 10, thereby lowering the temperature of the solenoid housing 40 and effectively cooling the fuel injector 24 associated with the solenoid housing 40.

In an exemplary embodiment, the heat sink 42 is axially positioned relative to the solenoid housing 40 along an axis 52 of the solenoid housing 40, as opposed to being radially positioned relative to solenoid housing 40, i.e., encompassing a circumference of the solenoid housing 40. The heat sink 42 may be attached to the solenoid housing 40 via any suitable fastener, such as by one or more bolts, one or more screws, a weld, a clamping mechanism, and/or a thermal adhesive.

In an exemplary embodiment, the heat sink 42 may be formed of a material having relatively good, i.e., higher, thermal conductivity as compared to a material which forms the solenoid housing 40. For example, the heat sink 42 may be formed of copper or aluminum alloy. Copper may have a thermal conductivity value of between approximately 390 W/(mK) at 300 K and 410 W/(mK) at 300 K and aluminum may have a thermal conductivity value of between approximately 200 W/(mK) at 300 K and 237 W/(mK) at 300 K. The heat sink 42 may also be formed of a synthetic diamond material and/or phase change materials, e.g., materials which have a large energy storage capacity. The solenoid housing 40 may be formed at least partially of steel, which may have a thermal conductivity value of approximately 50 W/(mK) at 300 K. In another embodiment, the heat sink 42 may be formed of silver, which provides a greater thermal conductivity value than copper. The heat sink 42 may also be formed of carbon nanotube particles.

In one embodiment, the heat sink 42 is formed of aluminum, which may provide an inexpensive method for production of the heat sink 42 via milling, die-casting, or cold forging, for example. Moreover, an aluminum heat sink places a minimal amount of stress on the solenoid housing 40 because of the relatively light weight of aluminum. In another embodiment, the heat sink 42 is formed of copper, which may provide methods for production of the heat sink 42 including milling, die-casting, or bonding copper plates together, for example. In yet another embodiment, the heat sink 42 is formed of a combination of aluminum and copper. In this embodiment, the surface 48 of the heat sink 42 is formed of copper which facilitates transfer of heat from the solenoid housing 40. The remainder of the heat sink 42 may be formed of aluminum, which is relatively cheaper and easier to manufacture as well as relatively lighter than copper to lower the stress on the solenoid housing 40.

In an exemplary embodiment, the surface 48 of the heat sink 42 is planar and smooth to ensure optimal thermal contact with the outer surface 46 of the solenoid housing 40. A thermally conductive grease or adhesive may be used between the surface 48 and the outer surface 46 to ensure optimal thermal contact therebetween. Such grease may contain ceramic materials such as beryllium oxide, aluminum nitride, and/or finely divided metal particles, e.g., colloidal silver.

The performance of the heat sink 42 may be enhanced by increasing the thermal conductivity of the materials which form the heat sink 42, by increasing the surface area of the heat sink 42 which contacts the solenoid housing 40, by increasing the surface area of the heat sink 42 which is exposed to the ambient air or other components of the engine 10 (FIG. 1), such as by adding one or more fins to the heat sink 42, and by increasing the overall area heat transfer coefficient, such as by adding a fan proximate the heat sink 42 to provide increased airflow over and around the heat sink 42.

Although depicted in FIGS. 2 and 3 as the surface 48 having a surface area less than 50% of a surface area of the outer surface 46, i.e., the surface contact area defined by surface 48 in thermal contact with the outer surface 46 is less than 50% of the total surface area of the outer surface 46, the surface 48 may have as much as 100%, 95%, 90%, 85%, 80%, 75%, 70%, 65%, 60%, or 55% of the surface area of the outer surface 46 or as little as 5%, 10%, 15%, 20%, 25%, 30%, 35%, 40%, 45%, or 50% of the surface area of the outer surface 46. In an exemplary embodiment as shown in FIGS. 2 and 3, the surface area defined by the surface 48 is approximately 25% of the surface area defined by the outer surface 46. The amount of surface area defined by the surface 48 with respect to the surface area defined by the outer surface 46 may be chosen to match desired thermal transfer characteristics and/or packaging requirements for the fuel injector 24.

Figure 4:
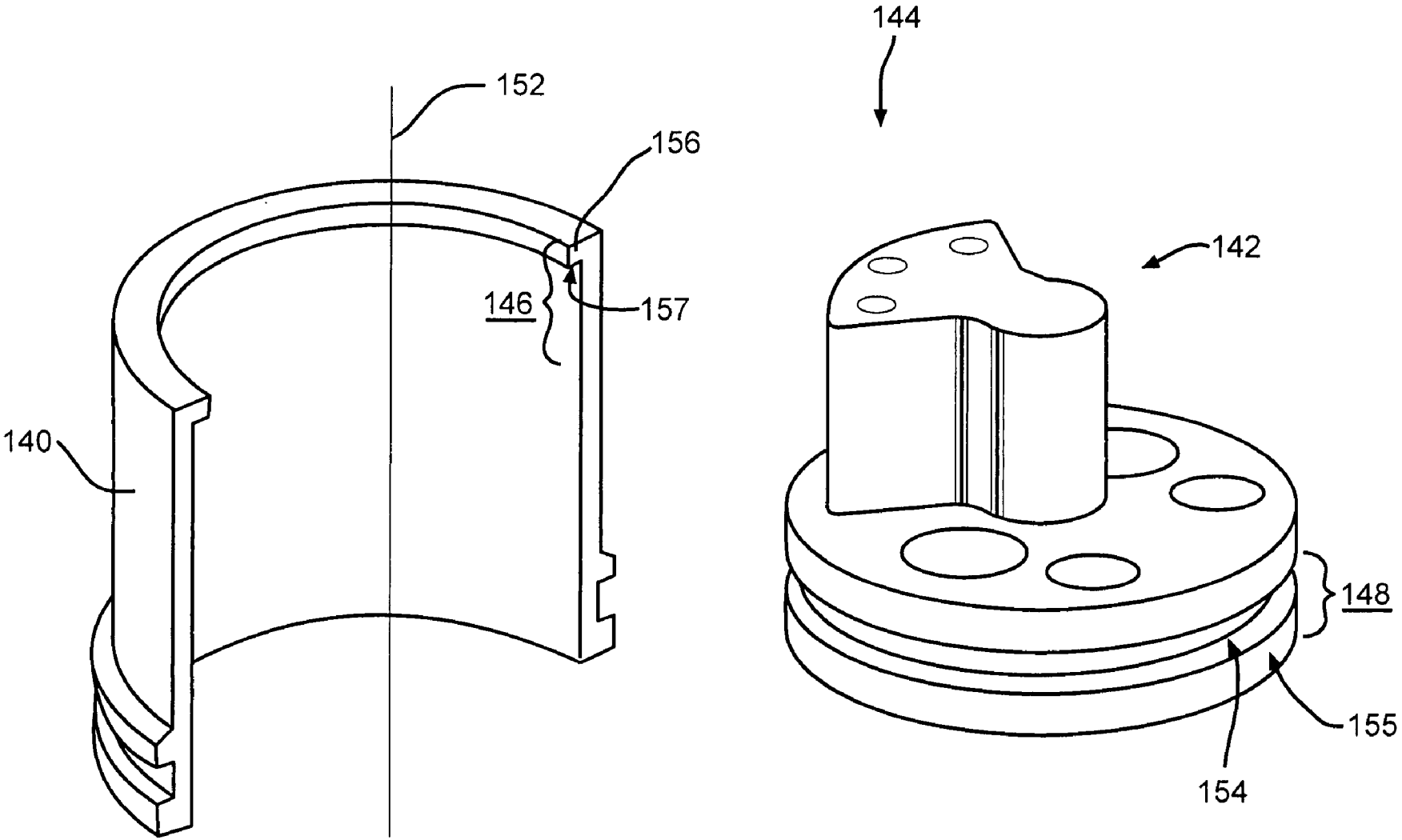
FIG. 4 is an exploded perspective view of a fuel injector solenoid housing and an associated heat sink according to another exemplary embodiment of the present disclosure.
Figure 5:
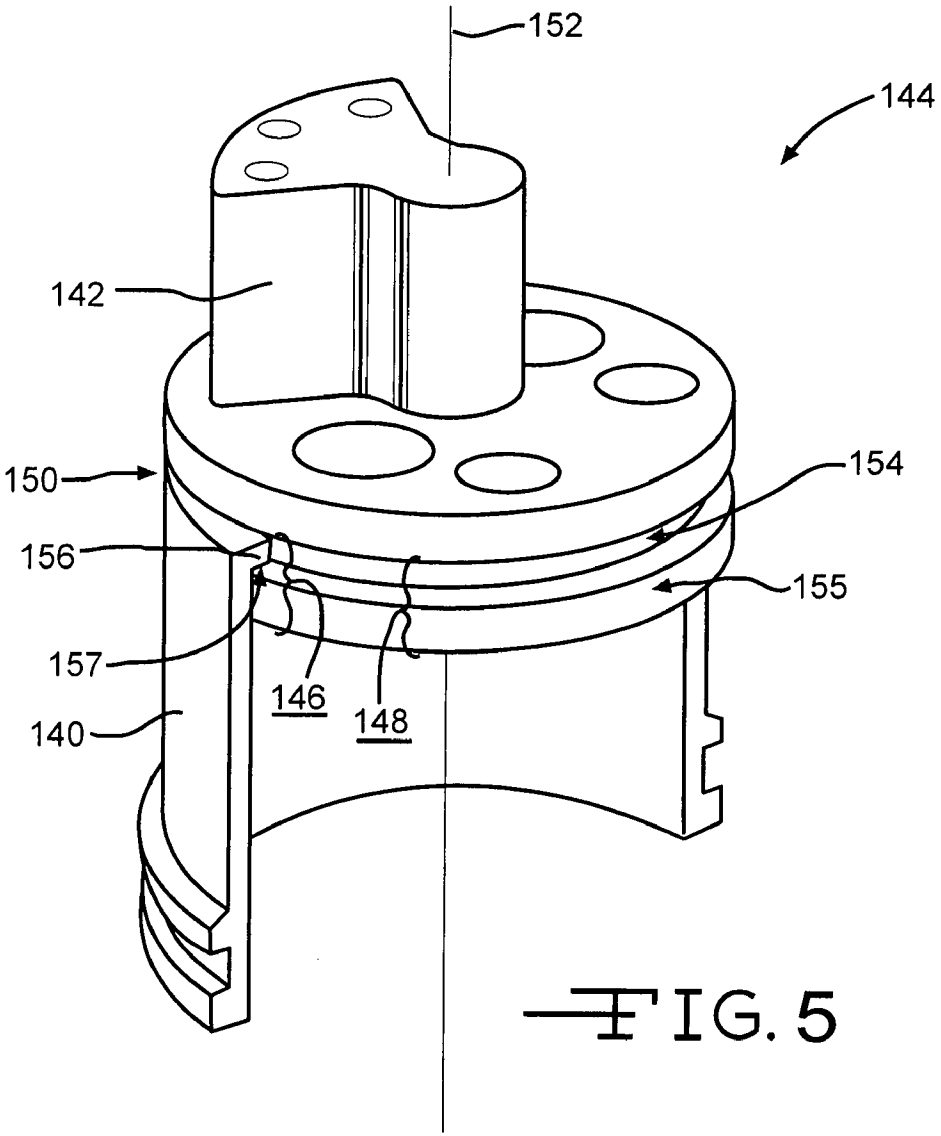
FIG. 5 is an assembled perspective view of the fuel injector solenoid housing and the heat sink of FIG. 4.

Referring now to FIGS. 4 and 5, another exemplary embodiment of a heat transfer assembly is illustrated. As shown assembled in FIG. 5, a heat transfer assembly 144 may be used, for example, in a fuel injector 24 shown in FIG. 1. The heat transfer assembly 144 includes a solenoid housing 140 and a heat sink 142. The solenoid housing 140 may be formed of a material substantially similar to the material of the solenoid housing 40, described above with reference to FIGS. 2 and 3. Similarly, the heat sink 142 may be formed of a material substantially similar to the material of the heat sink 42, described above with reference to FIGS. 2 and 3. The heat sink 142 provides a convenient and efficient way to absorb and dissipate excess heat generated within the solenoid housing 140, such as heat generated by the associated solenoid of the solenoid operated valve assembly 38 (FIG. 1) and by fuel within the fuel injector 24 (FIG. 1) proximate the solenoid housing 140, thereby effectively cooling the fuel injector 24 associated with the solenoid housing 140. In an exemplary embodiment, the heat transfer assembly 144 is disposed at an opposite end of the fuel injector 24 relative to the nozzle portion 25.

As shown in FIG. 4, the heat sink 142 includes a surface 148 which defines a portion of a heat transfer interface 150 (FIG. 5) between the heat sink 142 and the solenoid housing 140. The surface 148 may include a recess 154 and a protrusion 155. The solenoid housing 140 includes a surface 146 which defines another portion of the heat transfer interface 150 (FIG. 5) between the heat sink 142 and the solenoid housing 140. The surface 146 may include a protrusion 156 and a recess 157. The solenoid housing 140 is only partially shown in FIGS. 4 and 5 to more fully illustrate the components of the surface 146.

In operation, the surface 148 of the heat sink 142 is positioned in thermal contact with the surface 146 of the solenoid housing 140. More particularly, protrusion 156 of the solenoid housing 140 engages with recess 154 of the heat sink 142 and recess 157 of the solenoid housing 140 receives protrusion 155 of the heat sink 142. The positioning of the heat sink 142 and the solenoid housing 140 as shown in FIG. 5 ensures stable and efficient thermal contact between the surfaces 146, 148 upon assembly of the heat sink 142 and the solenoid housing 140. In operation, the surfaces 146, 148 are in thermal contact to transfer heat from the solenoid housing 140 to the heat sink 142. The heat sink 142 in turn dissipates the heat to the surrounding ambient air and/or to other components of the engine 10 (FIG. 1). The heat sink 142 functions substantially similar to the heat sink 42, described above with reference to FIGS. 2 and 3, to lower the temperature of the solenoid housing 140 and thereby cool the fuel injector 24.

In an alternative embodiment, the heat sink 142 is axially captured within the solenoid housing 140 via the protrusion 156. The protrusion 156 prevents the heat sink 142 from exiting the solenoid housing 140 proximate the surface 146. Such an arrangement permits axial movement of the heat sink 142 along an axis 152 of the solenoid housing 140 while maintaining sufficient thermal contact between at least portions of the surface 146 and the surface 148. The heat sink 142 may include additional protrusions similar to protrusion 155 to increase the thermal contact between the surface 146 and the surface 148. The axial movement capability of the heat sink 142 relative to the solenoid housing 140 facilitates meeting packaging requirements for the fuel injector 24.

In an exemplary embodiment, the heat sink 142 is axially positioned relative to the solenoid housing 140 along the axis 152 of the solenoid housing 140, as opposed to being radially positioned relative to solenoid housing 140, i.e., encompassing a circumference of the solenoid housing 140. The heat sink 142 may be attached to the solenoid housing 140 via any suitable fastener, such as by one or more bolts, one or more screws, a weld, a clamping mechanism, and/or a thermal adhesive.

In an exemplary embodiment, the recess 154 and the protrusion 155 of the heat sink 142 are planar and smooth to ensure optimal thermal contact with the respective protrusion 156 and the recess 157 of the solenoid housing 140. A thermally conductive grease may be used between the surfaces 146, 148 to ensure optimal thermal contact therebetween. Such grease may contain ceramic materials such as beryllium oxide, aluminum nitride, and/or finely divided metal particles, e.g., colloidal silver.

The performance of the heat sink 142 may be enhanced by increasing the thermal conductivity of the materials which form the heat sink 142, by increasing the surface area of the heat sink 142 which contacts the solenoid housing 140, by increasing the surface area of the heat sink 142 which is exposed to the ambient air or other components of the engine 10 (FIG. 1), such as by adding one or more fins to the heat sink 142, and by increasing the overall area heat transfer coefficient, such as by adding a fan proximate the heat sink 142 to provide increased airflow over and around the heat sink 142.

INDUSTRIAL APPLICABILITY

The disclosed apparatuses for cooling a fuel injector may be applicable to any engine utilizing a solenoid operated valve assembly, such as assemblies used in many types of fuel injectors.

In operation, the heat sink 42, 142 may provide an effective cooling mechanism to draw heat from the solenoid housing 40, 140 associated with a fuel injector 24. The heat absorbed by the heat sink 42, 142 may then be transferred to the surrounding air or other components of the engine 10. The heat sink 42, 142 may be formed of a material which has a relatively greater thermal conductivity value than the material forming the solenoid housing 40, 140 such that heat is absorbed from the solenoid housing 40, 140, thereby reducing the temperature of the solenoid housing 40, 140 and cooling the associated fuel injector 24.

It will be apparent to those skilled in the art that various modifications and variations can be made to the disclosed cooling apparatuses without departing from the scope of the disclosure. Other embodiments of the cooling apparatuses will be apparent to those skilled in the art from consideration of the specification and practice of the embodiments disclosed herein. It is intended that the specification and examples be considered as exemplary only, with a true scope of the disclosure being indicated by the following claims and their equivalents.

What is claimed is:

1. A fuel injector, comprising:

a nozzle portion;

a solenoid operated valve assembly configured to control a flow of fuel to the nozzle portion;

a housing, at least a portion of the solenoid operated valve assembly disposed in the housing, the housing formed of a first material having a first thermal conductivity value; and a heat transfer element associated with the solenoid operated valve assembly, the heat transfer element attached to the housing, and situated atop of the housing in an end-to-end planar facing relationship therewith, the heat transfer element formed of a second material having a second thermal conductivity value, the second thermal conductivity value being greater than the first thermal conductivity value.

2. The fuel injector of claim 1, wherein the housing defines a first surface and the heat transfer element defines a second surface, the first surface in thermal contact with the second surface.

3. The fuel injector of claim 2, wherein the first surface defines a first surface area and the second surface defines a second surface area, the first surface area being greater than the second surface area.

4. The fuel injector of claim 2, wherein the first surface defines a first surface area and the second surface defines a second surface area, the first surface area being substantially equal to the second surface area.

5. The fuel injector of claim 1, wherein the heat transfer element is disposed at an end of the fuel injector opposite the nozzle portion.

6. The fuel injector of claim 1, wherein the heat transfer element is disposed on an outer surface of the housing.

7. The fuel injector of claim 1, wherein the heat transfer element is axially arranged relative to the housing along an axis of the solenoid operated valve assembly.

8. The fuel injector of claim 1, wherein the heat transfer element is attached to the housing via a fastener.

9. The fuel injector of claim 1, wherein the heat transfer element is formed of at least one of aluminum and copper.

10. A heat transfer assembly for a solenoid operated valve assembly, comprising:

a housing configured to contain at least a portion of the solenoid operated valve assembly, the housing formed of a first material having a first thermal conductivity value; and a heat transfer element attached to the housing, and situated atop of the housing in an end-to-end planar facing relationship therewith, the heat transfer element formed of a second material having a second thermal conductivity value, the second thermal conductivity value being greater than the first thermal conductivity value;

wherein the heat transfer element is axially arranged relative to the housing along an axis of the solenoid operated valve assembly.

11. The heat transfer assembly of claim 10, wherein the housing defines a first surface and the heat transfer element defines a second surface, the first surface in thermal contact with the second surface.

12. The heat transfer assembly of claim 11, wherein the first surface defines a first surface area and the second surface defines a second surface area, the first surface area being greater than the second surface area.

13. The heat transfer assembly of claim 11, wherein the first surface defines a first surface area and the second surface defines a second surface area, the first surface area being substantially equal to the second surface area.

14. The heat transfer assembly of claim 10, wherein the heat transfer element is disposed on an outer surface of the housing.

15. The heat transfer assembly of claim 10, wherein the heat transfer element is attached to the housing via a fastener.

16. The heat transfer assembly of claim 10, wherein the heat transfer element is formed of at least one of aluminum and copper.

17. A machine, comprising:

an engine configured to generate a power output and including at least one combustion chamber; and a fuel injector configured to inject fuel into the at least one combustion chamber, the fuel injector including:

a nozzle portion;

a solenoid operated valve assembly configured to control a flow of fuel to the nozzle portion;

a housing, at least a portion of the solenoid operated valve assembly disposed in the housing, the housing formed of a first material having a first thermal conductivity value; and a heat transfer element associated with the solenoid operated valve assembly, the heat transfer element attached to the housing, and situated atop of the housing in an end-to-end planar facing relationship therewith, the heat transfer element formed of a second material having a second thermal conductivity value, the second thermal conductivity value being greater than the first thermal conductivity value.

18. The machine of claim 17, wherein the housing defines a first surface and the heat transfer element defines a second surface, the first surface in thermal contact with the second surface.

19. The machine of claim 17, wherein the heat transfer element is disposed at an end of the fuel injector opposite the corresponding combustion chamber.

20. The machine of claim 17, wherein the heat transfer element is axially arranged relative to the housing along an axis of the solenoid operated valve assembly.

* * * * *